United States Patent [19]

Thornton

[11] Patent Number: 4,942,792

[45] Date of Patent: Jul. 24, 1990

[54] STRIP LUG AND NUT REMOVER

[76] Inventor: Nelson E. Thornton, 1653 Thetford Rd., Towson, Md. 21204

[21] Appl. No.: 317,669

[22] Filed: Mar. 1, 1989

Related U.S. Application Data

[63] Continuation of Ser. No. 163,032, Mar. 2, 1988, abandoned, and a continuation of Ser. No. 317,669, Mar. 1, 1989.

[51] Int. Cl.[5] ..... B25B 13/50

[52] U.S. Cl. ..... 81/53.2; 81/95

[58] Field of Search ..... 81/53.2, 90.1–90.4, 81/95–96, 124.2, 59.1

[56] References Cited

U.S. PATENT DOCUMENTS 348,185 8/1886 Bowman ..... 81/53.2

FOREIGN PATENT DOCUMENTS 840338 4/1939 France ..... 81/124.2

*Primary Examiner*—D. S. Meislin

*Attorney, Agent, or Firm*—Walter G. Finch

[57] ABSTRACT

This invention consists of a strip lug and nut remover consisting of a metallic semi-circular housing having a circular top and a semi-circular bore. The wall of the bore is provided with three sets of teeth spaced apart from each other and running lengthwise and/or longitudinally of the bore. A hexagon nut is positioned on the top of the strip lug and nut remover. The hexagon nut receives the open head of a hexagon shaped wrench. A plurality of spaced holes are provided in the top of the housing, and a smaller rotatable pin attached to a larger diameter eccentrically mounted pin is positioned in the bore with the small pin passing through one of the two openings of the top of the housing smaller pin is held in position by a snap ring. When it is desired to use the strip lug and nut remover, it is positioned over a damaged nut to be removed and the eccentrically mounted pin is positioned adjacent thereto. The hexagonal wrench is positioned in the hexagonal nut attached to the strip lug and nut remover and rotated to alleviate the friction holding the damaged nut.

4 Claims, 1 Drawing Sheet

STRIP LUG AND NUT REMOVER

This invention relates to devices for removing stripped lug nuts, and more particularly to a strip lug and nut remover. This patent application is a continuation of U.S. Pat. application Ser. No. 07/163,032 now abandoned filed Mar. 2, 1988 for "Strip Lug and Nut remover" and U.S. Pat. application Ser. No. 07/317,669 filed Mar. 1, 1989.

BACKGROUND AND SUMMARY OF THE INVENTION

When there is a nut that is stripped, the normal way to remove it usually is by chiseling it off. This relates to standard nuts where there is a counterbored hole and/or aperture or flat back and also lugnuts on any motor vehicle or trailer.

The nut can be removed either with hand chisels, air chisels, and/or burning the nut off. Especially in the trucking line where there are square nuts that hold the two back wheels together, when these nuts strip, the nuts are burned off or the nuts will have a hole drilled through them and an easy-out is used to back them out.

The present strip lug and nut remover of this invention can be used to remove stripped nuts on automobiles, recreation vehicles, spark plugs, trucks and nuts.

It is to be noted that there are approximately 186,000,000 automobiles in this country, excluding military and governmental vehicles and that there are millions and millions of stripped nuts that need to be replaced.

It is an object of this invention to provide a strip lug and nut remover which is economical to manufacture, efficient in operation, and which is easy to maintain.

Still another object of this invention is to provide a strip lug and nut remover which is used for quickly removing stripped nuts.

And still another object of this invention is to provide a strip lug and nut remover which is operable with the use of a fire and/or chisel to remove a stripped nut.

And still another object of this invention is to provide a strip lug and nut remover which can be used to remove all sized damaged nuts.

Further another object of this invention is to provide a strip lug and nut remover for removing damaged and/or stripped nuts from automobiles, recreation vehicles, spark plugs, trucks, aircraft, and nuts.

DESCRIPTION OF THE PREFERRED EMBODIMENTS

Figure 1:
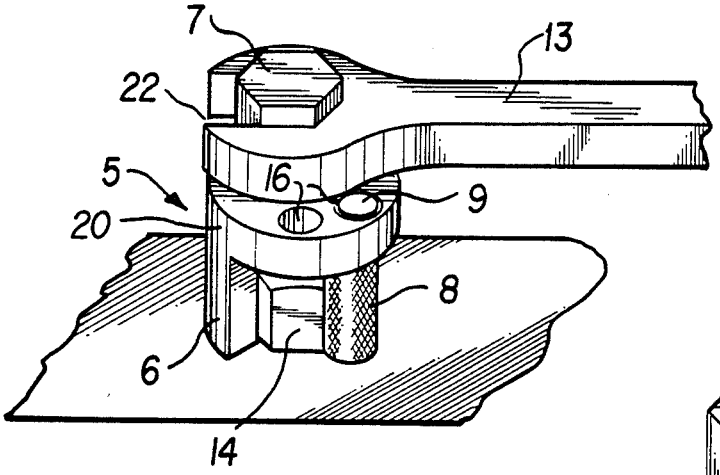
FIG. 1 is a perspective view of a preferred embodiment of the strip lug and nut remover incorporating features of this invention.
Figure 2:
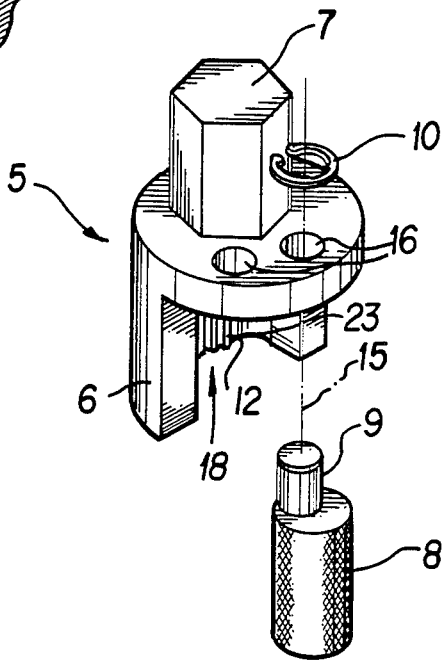
FIG. 2 is an exploded perspective view of the strip lug and nut of FIG. 1.
Figure 3:
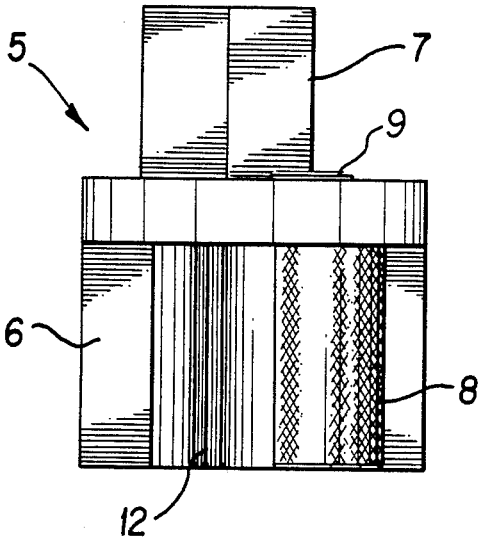
FIG. 3 is a front elevation of the strip lug and nut remover of FIG. 1.

Referring now to FIGS. 1 to 4, there is illustrated a preferred embodiment of a strip lug and nut remover 5 incorporating features of this invention. This strip lug and nut remover 5, as shown best in FIGS. 1 to 3 consists of a thick metallic semi-circular housing 6 having a semi-circular bore 18 as best shown in FIG. 2. The wall of the bore 18 has two sets of spaced teeth 12 shown best in FIGS. 2, 3 and 4, and running lengthwise, that is, longitudinal of the bore 18.

A series of arcuate grooves 23 are located between the sets of spaced teeth 12 and are of the same length as the sets of spaced teeth 12. The edges and/or corners of the damaged nut 14 are positioned against these teeth 12 and/or grooves 23.

A hexagon nut 7 is formed integral with the cylindrical top 20 of the strip lug and nut remover 5. This hexagon nut 7 receives the opening 22 of the hexagonal shaped wrench 13.

The top 20 of the strip lug and nut remover 5 has a plurality of spaced holes 16 provided therethrough. An upper eccentric pin 9 is integrally secured to a thicker pin 8, and it is inserted in one of the two holes 16. A snap ring 10 is used to hold the pin 9 in position in the hole 16 as best shown in FIG. 1, where the top 20 of the pin 9 is shown. The axis of revolution 15 of the pin 9 is shown in FIG. 2 for the eccentric roll or pin 8. The direction of rotation of the eccentric or pin 8 is illustrated by the arrow direction 11.

Figure 4:
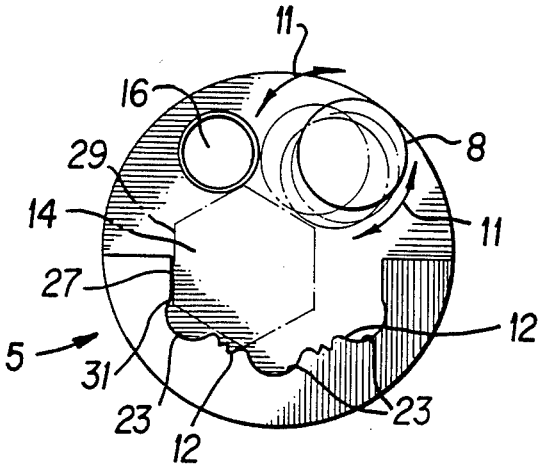
FIG. 4 is a bottom plan view of the strip lug and nut remover of FIG. 1 showing the direction of the gripping pin.

A stripped nut 14 is shown in FIGS. 1 and 4. When it is desired to remove and/or replace the stripped nut 14, the strip lug and nut remover 5 is placed over the damaged nut 14 as shown in FIG. 4 and the opening 22 of the head of the wrench 13 is placed over the nut 7, as shown in FIG. 1. As shown in FIG. 4, the strip lug and nut remover 5 is positioned so that its shoulder 27 is located against one of the faces 29 of the nut 14 and one of its teeth 12 is located adjacent shoulder 27. The pin 8, with its pin head is positioned in the desired hole 16.

The eccentrically mounted eccentric pin 8 is placed in engagement with the damaged nut 14 as shown in FIG. 4. Upon turning and/or rotating the wrench 13 in the proper direction, the eccentrically mounted pin is positioned in engagement, the damaged nut 14 is broken against its adjacent structure and it can be removed from its mating structure.

As can be readily understood from the foregoing description of the invention, the present structure can be configured in different modes to provide the ability to anchor and object.

Accordingly, modifications and variations to which the invention is susceptible may be practiced without departing from the scope and intent of the appended claims.

What is claimed is:

1. A strip lug and nut remover for removing a stripped nut, comprising a substantially semi-circular hollow housing with a semi-circular bore therein and having a circular shaped closed top and a shoulder of semi-circular shape formed integrally with said closed top and arranged and extending perpendicularly thereto to form said semi-circular bore, said housing having an inner surface, at least two spaced sets of spaced teeth formed in said inner surface of said shoulder of said hollow housing and extending longitudinally of said hollow housing, a series of arcuate grooves formed in the inner surface of said shoulder, each groove being the same length as each set of spaced teeth, said sets of teeth and said arcuate grooves being alternately disposed along said inner surface of said such that one of said arcuate grooves is positioned between said sets of spaced teeth housing with the edges and corner of a stripped nut being positioned against the sets of teeth and grooves, a lug means extending upwardly from said closed top and formed integrally therewith, said top of said hollow housing having at least one aperture extending therethrough, and an eccentrically mounted pin means coupled in one of said at least one aperture in said top of said hollow housing and extending longitudinally downwardly from said top therefrom to engage a stripped nut to be removed, wherein when the semi-circular hollow housing of said strip lug and nut remover is placed over a stripped nut, with the head of a lug wrench being placed over said lug means, with said strip lug and nut remover being and positioned so its shoulder is located against one of the faces of said stripped nut and one of its edges and with said eccentrically mounted pin means is arranged to engage an opposite side of said stripped nut so that when said lug wrench is rotated in the proper direction, said eccentrically mounted pin is positioned in engagement with said stripped nut, and said stripped nut is broken against its adjacent structure so that it can be removed from its mating structure.

2. A strip lug and nut remover as recited in claim 1, and lug means for engaging and rotating said lug receiving means.

3. A strip lug and nut remover as recited in claim 1, wherein said lug means consists of a hexagonal headed nut.

4. A strip lug and nut remover as recited in claim 1, and said eccentrically mounted pin means consists of a first pin of smaller diameter than a second pin, with said first pin being positioned in said one of said at least one aperture in said top and said second pin being eccentrically mounted and formed with said first pin and coextensive with said semi-circular housing and mounted eccentrically to said first pin and said semi-circular housing.

* * * * *